United States Patent [19]

Losiowski et al.

[11] Patent Number: 4,546,686

[45] Date of Patent: Oct. 15, 1985

[54] BAGEL SLICER

[76] Inventors: John J. Losiowski; George J. Low, both of 300 Plum Space 91, Capitola, Calif. 95010

[21] Appl. No.: 632,594

[22] Filed: Jul. 19, 1984

[51] Int. Cl.[4] ..... B26D 1/02

[52] U.S. Cl. ..... 83/874; 83/431; 83/856

[58] Field of Search ..... 83/870, 874, 421, 431, 83/699, 700, 856–858

[56] References Cited

U.S. PATENT DOCUMENTS

| | | | |
|---|---|---|---|
| 344,379 | 6/1886 | Humphrey et al. | 83/431 |
| 2,009,913 | 7/1935 | Bever | 83/431 |
| 2,103,537 | 12/1937 | Hillman | 83/431 |
| 2,279,376 | 4/1942 | Marnott | 83/431 |

*Primary Examiner*—James M. Meister

*Assistant Examiner*—John L. Knoble

[57] ABSTRACT

A portable hand operated bagel slicing machine which slices or preslices bagels quickly, evenly and safely. Eliminating the hazards of slicing bagels in Bagel Bakerys, Restaurant, and Homes. It's light weight and will fit most kitchen work areas. It preslices a bagel by leaving a space in the center of the two blades. This leaves a small strip of dough through the middle of the bagel. The bagel halves stay together and can easily be separated later. Blades in the device are adjustable so one can achieve any degree of horizontal slicing. Jamming of the pusher from residue is prevented by a recess under the pusher. Slicing a bagel with the device is achieved by placing the device on the edge of a convenient table, counter, or cutting board. Insert a bagel in the top opening. Push the handle forward. The bagel exits the front of the device sliced.

3 Claims, 5 Drawing Figures

BAGEL SLICER

This invention relates to machines for slicing buns, rolls, and the like, and in particularly, to an portable machine for horizontally, splitting or slicing bagels at Bagel bakerys, restaurants, and homes.

Heretofore two methods were used to slice bagels for a sandwich. One method is to lay the bagel flat on a cutting board, holding it down with the palm of one hand, then slice it horizontally with a knife. The other method is to have the bagel held in an upright position by some device, than use a knife to slice it. Both methods expose the person to the sharp edge of a knife, and the same chance of inflicting small cuts or more serious injuries. The primary object of the present invention is to provide a simple, portable, and easily operated device by means of which Bagels such as are served in Bagel bakerys, Restaurants and Homes may be easly and quickly split or sliced horizontally into two parts.

A further object of the invention is to provide a device for splitting or slicing bagels, which can be operated without the user running any risk of cutting oneself. Still further object of the invention is to Provide a device for splitter or slicing which will have few parts and will be comparatively simple and inexpensive to manufacture and which will require a minimum amount of upkeep.

The invention will be best understood from a consideration of the following detailed description taken in connection with the accompanying drawing forming part of this specification, with the understanding, however, that the invention is not confined to any strict conformity with the showing of the drawing but may be changed or modified so long as such changes or modifications mark no material departure from the salient features of the invention as expressed in the appended claims.

DETAILED DESCRIPTION OF THE PREFERRED EMBODIMENT

Figure 1:
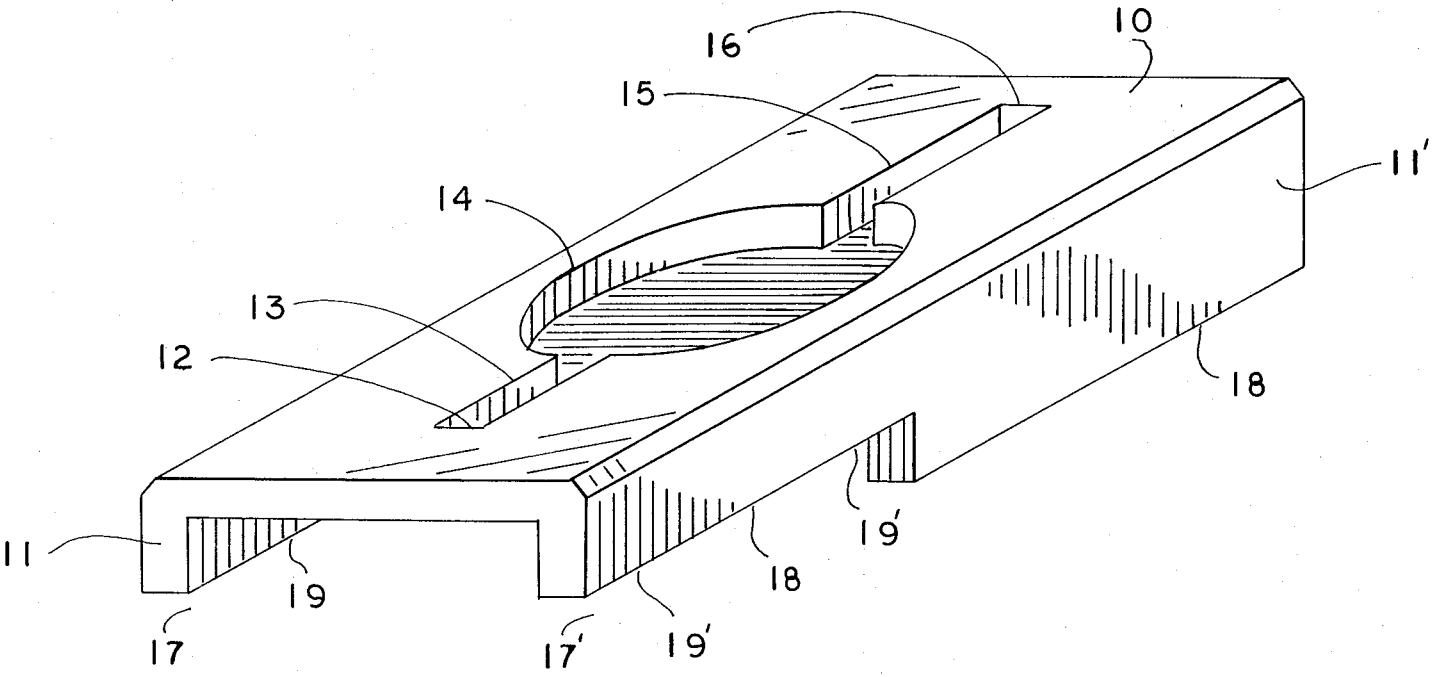
FIG. 1. is a perspective view of the devices top cover.

The materials used to construct this device are high quality plywood. The pusher uses hardwood and plywood. The handle uses wood dowel. Metal split pins are used as guide pins. Metal threaded inserts with bolts are used to clamp the top to the base. The blades are steel, razor sharpened at the inward angle.

Referring to the drawing wherein like numerals of reference designate corresponding parts throughout the several views. The number 42 indicates a portion of a table, bench, counter or cutting board, to which the device is shown in position on. The number 43 indicates a bagel.

The device embodying the present invention is shown in the three isometric projections. The three main components of the device are, the Top Cover FIG. 1., Pusher FIG. 2., and Base Assembly FIG. 3.

DESCRIPTION OF THE TOP COVER

Figure 2:
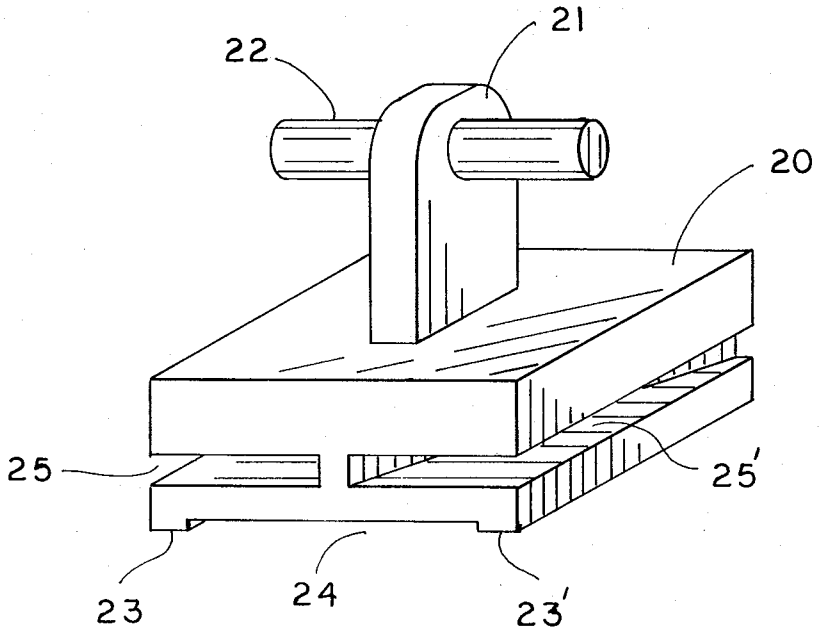
FIG. 2. is a perspective view of the devices pusher.

The top 10 and sides 11 and 11' form the top cover FIG. 1. of the device. At the center of the top 10 is a round bagel opening 14. To the front of the opening is a rectangular slot 13 with a cushion 12 at its end. To the rear of the opening is another rectangular slot 15 also with a cushion 16. At the front, and to the bottom of the top cover are indents 17 and 17'. The indent dimensions being the same as the pedestals 27 and 27', spacers 28 and 28', and blades 29 and 29' combined. At the bottom edges of the indents 17 and 17' are Guide pin 30 clearance holes 19 in four places. A 45 degree cosmetic cut is made at both top side edges of the top cover.

DESCRIPTION OF THE PUSHER

The pusher body 20 is a rectangular block which is disposed inside the device. Under and to each side of the pusher body 20 are raised strips that act as runners. These runners 23 and 23' create a recess 24 under the body. Two horizontal blade gaps 25 and 25' start at the center and front of the pusher body 20 and run to the back corner of either side. The blade gaps 25 and 25' inside dimensions are the blades 26 and 26' dimension. The width of the gap is determined by the highest and lowest blade height of the blades in the device. In the center and to the top of the pusher body is the handle extension 21. At the end of the extension handle 21 is the handle 22.

DESCRIPTION OF THE BASE ASSEMBLY

Figure 3:
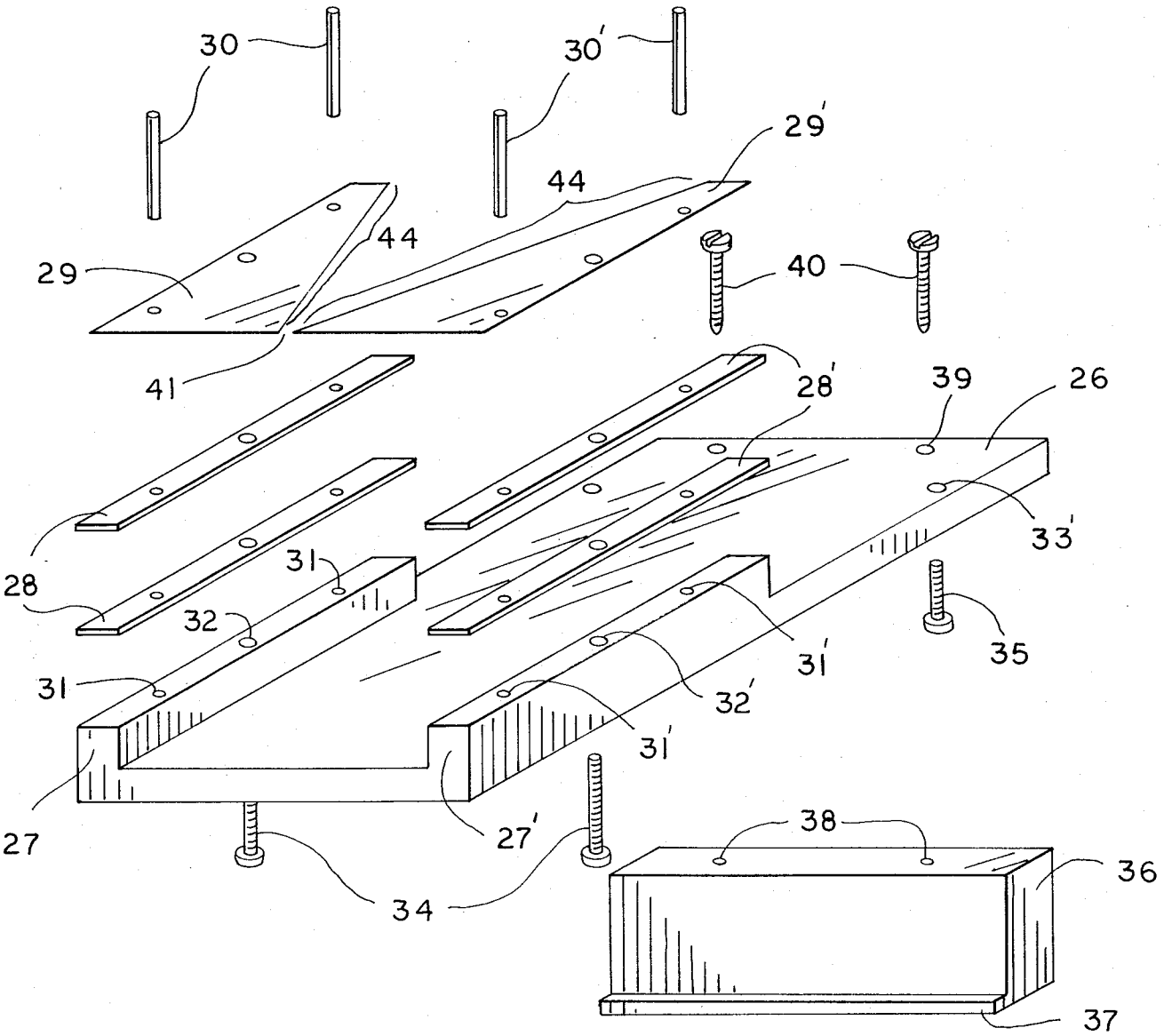
FIG. 3. is a perspective view of the devices base assembly.

The base assembly FIG. 3. are comrpised of the following components. Two pedestals 27 and 27' which are mounted on the forward corners and at the top of the base 26. The height of the pedestals are determined by the minimum height requirement, needed for slicing bagels. The pedestals 27 and 27' have assembly mounting bolt clearance holes 32 and 32', and guide pin clearance holes 31 and 31'. Four guide pins 30 and 30' are positioned in the guide pin clearance holes 31 and 31', in the pedestals 27 and 27'. Positioned on the pedestals are two sets of blade height adjustment spacers 28 and 28' with mounting bolt clearance holes 32 and 32', and guide pin clearance holes 31 and 31'. Also in postion on the pedestals with the spacers are Two steel blades 29 and 29' also having mounting bolt clearance holes 32 and 32', and guide pin clearance holes 31 and 31'. At the inward angle of the blades 29 and 29' is the cutting edge 44. A slide stop 36 in the form of a rectangular block with an anti lifting edge 37 protruding at the bottom forward side, is mounted to the under side of the base 26.

OPERATION OF THE TOP COVER

The devices top cover consist of the top 10 and sides 11 and 11'. In the center of the top 10 is a round opening which allows one to drop a bagel into the slicer device. Slots 13 and 15 at the front and rear of the top cover allow passage of the pusher extention 21 to move from rear stop 16 to the front stop 12. Rubber cushions at the rear of stop 16 and the front stop 12. absorb the shock of the pusher extension 21 impacting the enclouser. Indents 17 and 17' allow for the combined clearance of the base assembly FIG. 3. pedestals 27 and 27', spacers 28 and 28', and blades 29 and 29'. Guide pin Clearance holes 19 and 19' are placed in the top cover FIG. 1.

indent side edges. Metal Threaded inserts 18 are positioned in four places off each corner of the top cover FIG. 1. to secure the enclouser.

OPERATION OF THE PUSHER

The pusher body 20 dimensions are the same as the enclousers internal dimensions. Some reasonable internal clearance should be provided for free movement of the pusher FIG. 2. inside the enclouser. An extension 21 is provided to extend the handle 22 outside of the enclouser. The handle 22 makes it easier to grasp with the hand. The blade gap 25 and 25' provides clearance for the blades 29 and 29' when the pusher is in the most forward position. The width of the gap is equal to the lowest and highest height adjustment of the blades 26 and 26' in the device. The two Runners 23 and 23' ride inside the device, and on the base 26. The runners in turn forms a recess 24 that prevents the compression of residue under the pusher body.

OPERATION OF THE BASE ASSEMBLY

The base assembly's FIG. 3. pedestals 27 and 27' provide support for the blades 29 and 29', and spacers 28 and 28'. The guide pins 30 and 30' in place on the pedestals 27 and 27' prevents any movement of the blades 29 and 29' and spacers 28 and 28'. The blades 26 and 26' when in position on the pedestals 27 and 27' have a space 41 between them. This space between the blades performs the preslicing function. It leaving a small strip through the middle of a bagel so the halves do not separate. The stop 36 at the under side of the base 26 prevents the device from sliding forward on the table. The anti lift edge 37 catches the inside edge of the table and prevents the device from lifting over the edge of the table.

ASSEMBLING THE BAGEL SLICER

To assemble the device, place the base assembly FIG. 3. flat on a table 42 with the slide stop 36 overhanging the tables edge, and the pedestals 27 and 27' forward. Insert the guide pins 30 into the clearance holes 31 and 31' on the pedestals 27 and 27'. Select the proper blade height by positioning the blades 29 and 29' either above, below or between the two spacers 28 and 28'. With the blade cutting edges 44 and 44' inward. Grasp the top cover FIG. 1. with one hand, and with the other, pass the pushers handle 22 through the bagel opening 14 of the top cover. Making sure the blade gaps 25 and 25' in the pusher are forward. Draw the pusher extension 21 through the rear slot 15 toward the rear stop 16. The top cover and pusher are now positioned over the pedestals 27 and 27', blades 29 and 29', and spacers 28 and 28' on the base assembly. This entire enclouser is secured by bolts 34 and 35 using clearance holes 32 and 33 respectively, and tightened into the top covers threaded inserts.

OPERATION OF THE BAGEL SLICER

Figure 4:
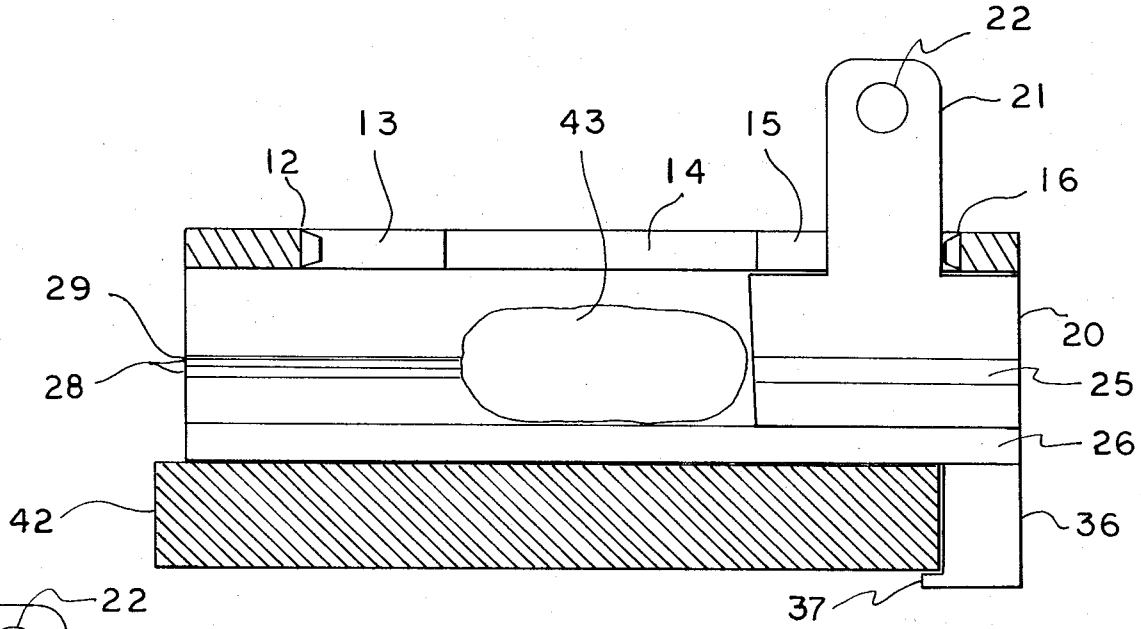
FIG. 4. is a side view of the device embodying the present invention positioned on a table, bench, or counter with a bagel in place ready for cutting. Portion of the device being broken away to more clearly show interior construction and operation.
Figure 5:
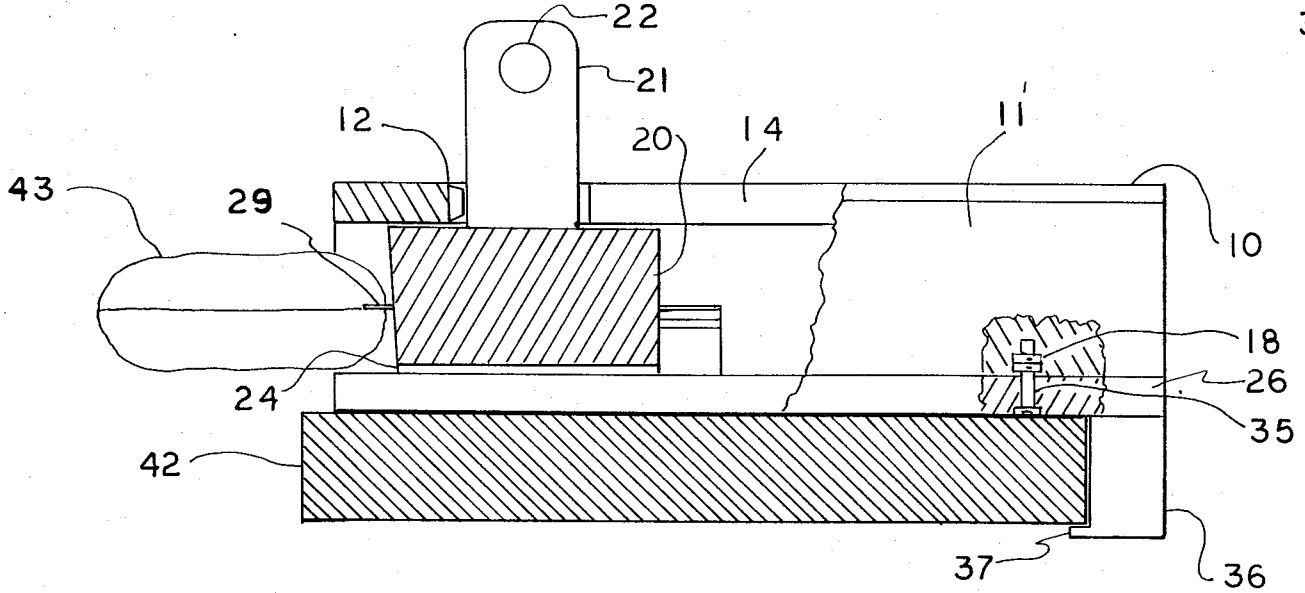
FIG. 5. is a side view of the device as in FIG. 4. with the slicing operation completed.

Refering to FIG. 4. the pusher body 20 is pulled back to the rear stop 16, using handle 22. A bagel 43 is placed through the top opening 14, and allowed to rest inside the device. Pushing forward on the handle toward the front stop 12 will force the bagel 43 through the blades 29 and 29'. In FIG. 5. the bagel is shown exiting the device through the front, past the blades, 26 and 26' thus slicing the bagel.

This device effectively slices the majority of the most difficult bagels that are being sliced in Bagel Bakerys, Restaurants, and Homes. These are the bagels with a crusty exterior or have a high density. These are also the bagels that inflict the most injuries to people.

While the above description contains many specifications, these should not be construed as limitations on the invention, but rather as an exemplification of one preferred embodiment thereof. Many other variations are possible, for example:

1. The blade height can be either fixed or variable.
2. The size of the device can vary with bagel sizes.
3. Different materials and combination of materials can be used in the construction of this device, such as Wood, Metals, or Plastics.

4. A tray can be added to the front of this device to catch loose seeds discharged during the bagel slicing operation.

Accordingly, the scope of the invention should be determined not by the embodiment illustrated, but by the appended claims and their legal equivalents.

I claim as my invention:

1. A hand operated slicing device comprising a top wall, two side walls and a bottom wall, the top wall having a feed opening for receiving a bagel into the device for slicing; and an elongate slot that is parallel to said side walls and intersects said feed opening; a pusher mechanism that is disposed within the space defined by the four walls, said pusher mechanism having a handle which extends through said slot; a stationary knife having a cutting edge parallel to the planes of the top and bottom walls, and a slide stop depending from said bottom wall for abutting a table edge said slide stop having an anti-lifting edge thereon that engages the underside of the table.

2. The slicing device of claim 1 wherein the knife may be vertically adjusted relative to the top and bottom walls.

3. The slicing device of claim 1 wherein a recess is provided beneath the pusher in said bottom wall for the purpose of preventing jamming of said pusher.

* * * * *